US006835095B2

(12) United States Patent
Chen

(10) Patent No.: US 6,835,095 B2
(45) Date of Patent: Dec. 28, 2004

(54) RADIO FREQUENCY COAXIAL CONNECTOR

(76) Inventor: Parry Chen, Fl. 1, No. 13 Lane 188, Jiun Gong Road., Taipei (TW)

( * ) Notice: Subject to any disclaimer, the term of this patent is extended or adjusted under 35 U.S.C. 154(b) by 0 days.

(21) Appl. No.: 10/458,254

(22) Filed: Jun. 11, 2003

(65) Prior Publication Data

US 2004/0229512 A1 Nov. 18, 2004

(30) Foreign Application Priority Data

May 16, 2003 (TW) ..... 92113386 A

(51) Int. Cl.[7] ..... H01R 9/05
(52) U.S. Cl. ..... 439/578; 439/700
(58) Field of Search ..... 439/578, 583, 439/638, 584, 654, 700, 824

(56) References Cited

U.S. PATENT DOCUMENTS 2,825,882 A * 3/1958 Mitchell ..... 439/34
3,416,125 A * 12/1968 Theve ..... 439/638
3,835,439 A * 9/1974 Yonkers ..... 439/187
4,333,697 A * 6/1982 Dreyer ..... 439/166
4,355,857 A * 10/1982 Hayward ..... 439/578
4,648,683 A * 3/1987 Botka ..... 439/583
4,655,526 A * 4/1987 Shaffer ..... 439/268
4,797,126 A * 1/1989 Botka ..... 439/843
4,904,213 A * 2/1990 Hock et al. ..... 439/824
4,925,403 A * 5/1990 Zorzy ..... 439/578
5,133,680 A * 7/1992 Watson et al. ..... 439/824
5,151,040 A * 9/1992 Tanaka ..... 439/73
5,417,595 A * 5/1995 Cullen et al. ..... 439/700
5,458,509 A * 10/1995 Hiraoka et al. ..... 439/700
5,558,538 A * 9/1996 Delalle ..... 439/583
5,641,315 A * 6/1997 Swart et al. ..... 439/824
6,053,777 A * 4/2000 Boyle ..... 439/700
6,104,205 A * 8/2000 Mawby ..... 324/761
6,227,868 B1 * 5/2001 Wlodarski ..... 439/63
6,275,054 B1 * 8/2001 Boyle ..... 324/754
6,652,326 B2 * 11/2003 Boyle et al. ..... 439/700

* cited by examiner

*Primary Examiner*—Tho D. Ta
*Assistant Examiner*—Larisa Tsukerman
(74) *Attorney, Agent, or Firm*—Bacon & Thomas, PLLC

(57) ABSTRACT

A radio frequency (RF) coaxial conductor. The connector includes an outer conductor, an inner conductor, and a dielectric insulator. The outer conductor and the inner conductor are concentrically positioned and insulated by the dielectric insulator. An insertion hole is disposed axially in the interface end of the inner conductor and an elastic element and U-type cylinder are installed in the hole. The outer wall of the U-type cylinder physically contacts the inner wall of the hole to form an electric continuity between the U-type cylinder and the inner conductor. The elastic element installed below the U-type cylinder provides rebounding force on the U-type cylinder when the center conductor of a coaxial cable is inserted and pressed into the U-type cylinder to ensure a good electric continuity between the center conductor and the inner conductor of the RF coaxial connector regardless of the cut length of the cable center conductor.

6 Claims, 6 Drawing Sheets

RADIO FREQUENCY COAXIAL CONNECTOR

BACKGROUND OF THE INVENTION

1. Field of the Invention

The present invention relates to a Radio Frequency (RF) coaxial connector, and more particularly to a female RF coaxial connector used for mating with male RF coaxial connectors which are of various different diameters of inner conductors, due to the different types of coaxial cables selected for use, while maintaining consistent mechanical and electrical properties over a significant number of mating cycles.

2. Description of Related Art

The technological advancement has been calling for broader bandwidths for the RE equipment. As a result, the RF coaxial connectors, either on the coaxial cable ends or on the PC boards of signal devices, play a more and more important role in signal input and output. The characteristic impedance of a RF coaxial connector must match that of the signal source device when a broadband signal is transmitted so as to obtain a minimum return loss and attenuation.

Figure 1:
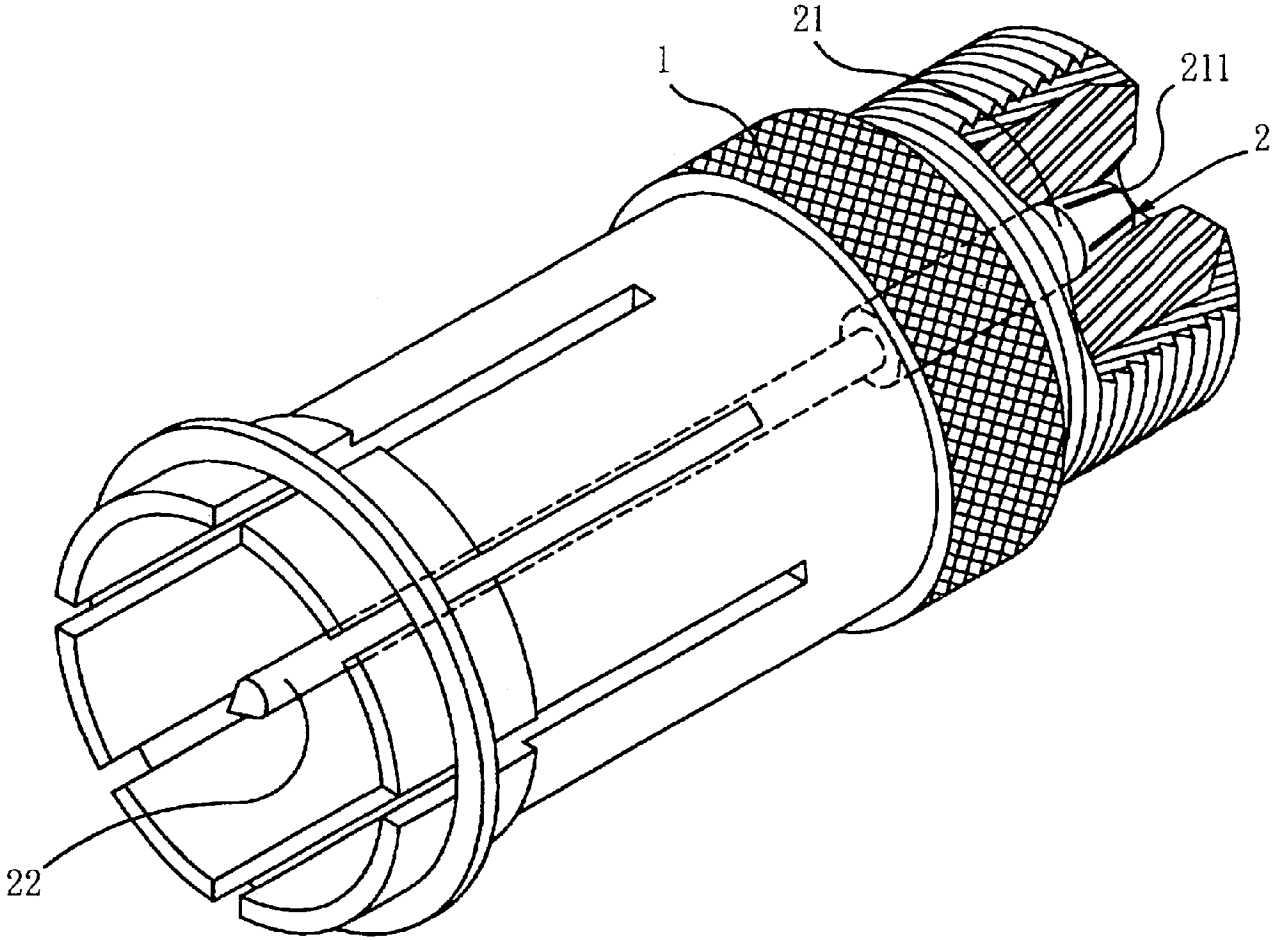
Figure 2:
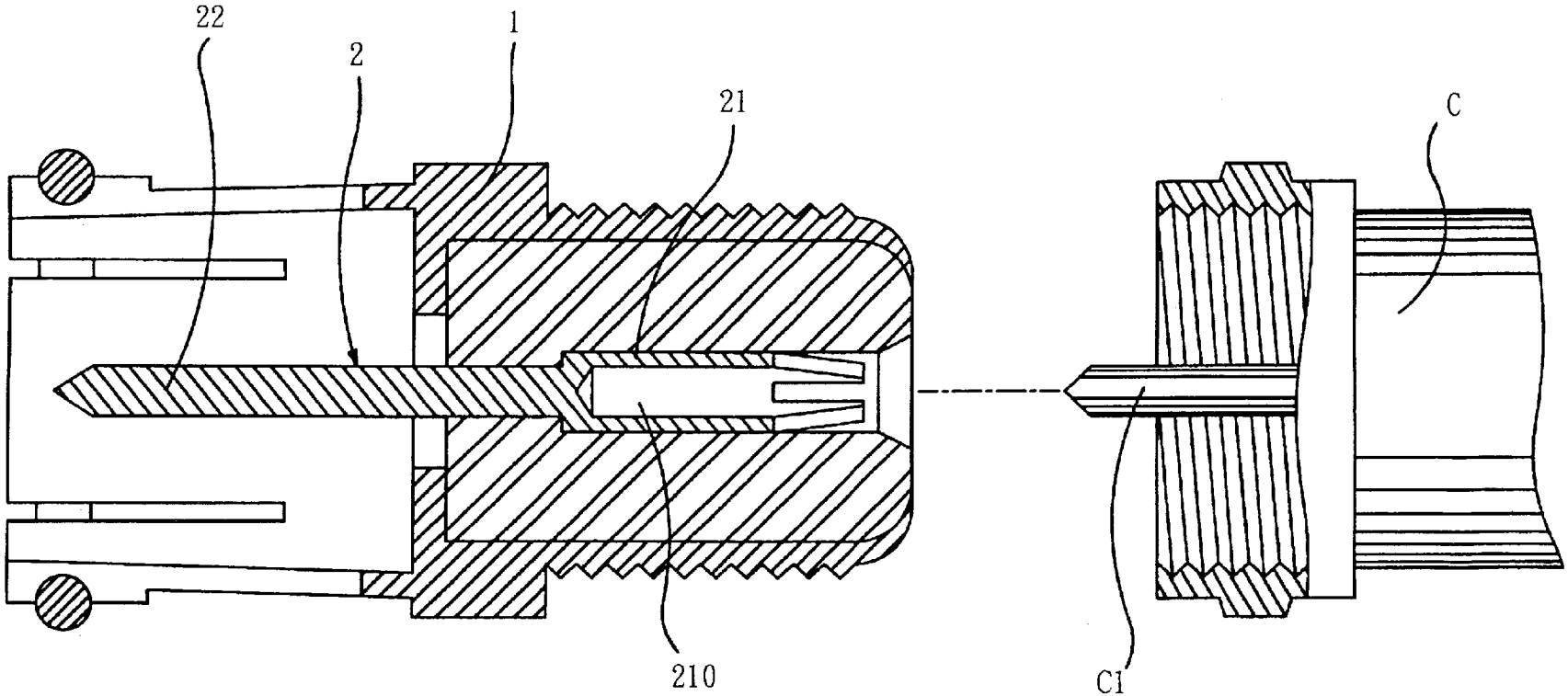

As shown in FIGS. 1 and 2, a known conventional RF coaxial connector has a hollow outer conductor (1) inside which a dielectric insulated inner conductor (2) is concentrically installed. The inner conductor (2) consists of a rear end (21) and front end (22). The diameter of the rear end (21) is bigger than that of the front end (22). An insertion hole (210) is provided at the rear end (21). The insertion hole rim (211), being slit and crimped for spring and retention capabilities, will accept and secure firmly the coaxial cable center conductor (C1) which has a slightly larger diameter than the inner diameter of the crimped insertion hole rim (211). As known to us, however, different types of coaxial cables (C) have different diameter sizes of cable center conductors (C1) ranging from 0.5 to 1.2 mm for example. The known conventional RF coaxial connector is designed for mating only with a specific diameter of the coaxial cable center conductor. Various coaxial connectors with different specifications are required for accepting various different cable center conductor diameters, which is not an ideal practice for users.

For improving the aforementioned RF coaxial connector, a modified version of RF coaxial connector using an inner clip fingers inside the insertion hole as displayed in Taiwan patent NO. 304,636 is brought out. The modified RF coaxial connector, according to the patent, declares that it can work with many different sizes of coaxial cables. Since different sizes of coaxial cables have different sizes of cable center conductors, an issue does not come out if the RF coaxial connector were used on a small size cable center conductor (C1) at the first time and on a larger size one at a later time. But if it were used on a large size cable center conductor (C1) at the first time, the inner clip fingers inside the RF coaxial connector inner conductor will flare out and will not recover back to its original shape due to elastic fatigue. As a result, an intermittent signal transmission or electrical continuity failure might be experienced when it is next used on a smaller diameter cable center conductor later on.

Both of the aforementioned two kinds of RF coaxial connectors intrinsically utilize the same slit-and-crimp method for the inner conductors. Besides the elastic fatigue issue, this method is difficult and time-consuming for production.

SUMMARY OF THE INVENTION

The main objective of the present invention is to provide a female RF coaxial connector with an inner conductor mechanism that is capable of mating with various different diameters of center conductors of various different coaxial cables while maintaining consistent electrical and mechanical properties over a significant number of mating cycles.

To actualize the objective, the present invention of the RE coaxial connector has a hollow outer conductor inside which a concentrically positioned and dielectric insulated inner conductor is installed. The inner conductor features an interface end insertion hole inside which an elastic element and a U-type cylinder are installed. The outer wall of the U-type cylinder physically contacts the inner wall of the insertion hole of the inner conductor for electrical continuity. The elastic element sits right under the bottom of the U-type cylinder providing the U-type cylinder with extended travel distance for accepting various different cut lengths of the coaxial cable center conductors while maintaining solid electrical continuity between the cable center conductor and the connector inner conductor. The inner diameter of the U-type cylinder is specially designed for accommodating different diameters of center conductors of different coaxial cables, which is convenient for users to choose and replace with different coaxial cables from time to time.

BRIEF DESCRIPTIONS OF DRAWINGS

Figure 3:
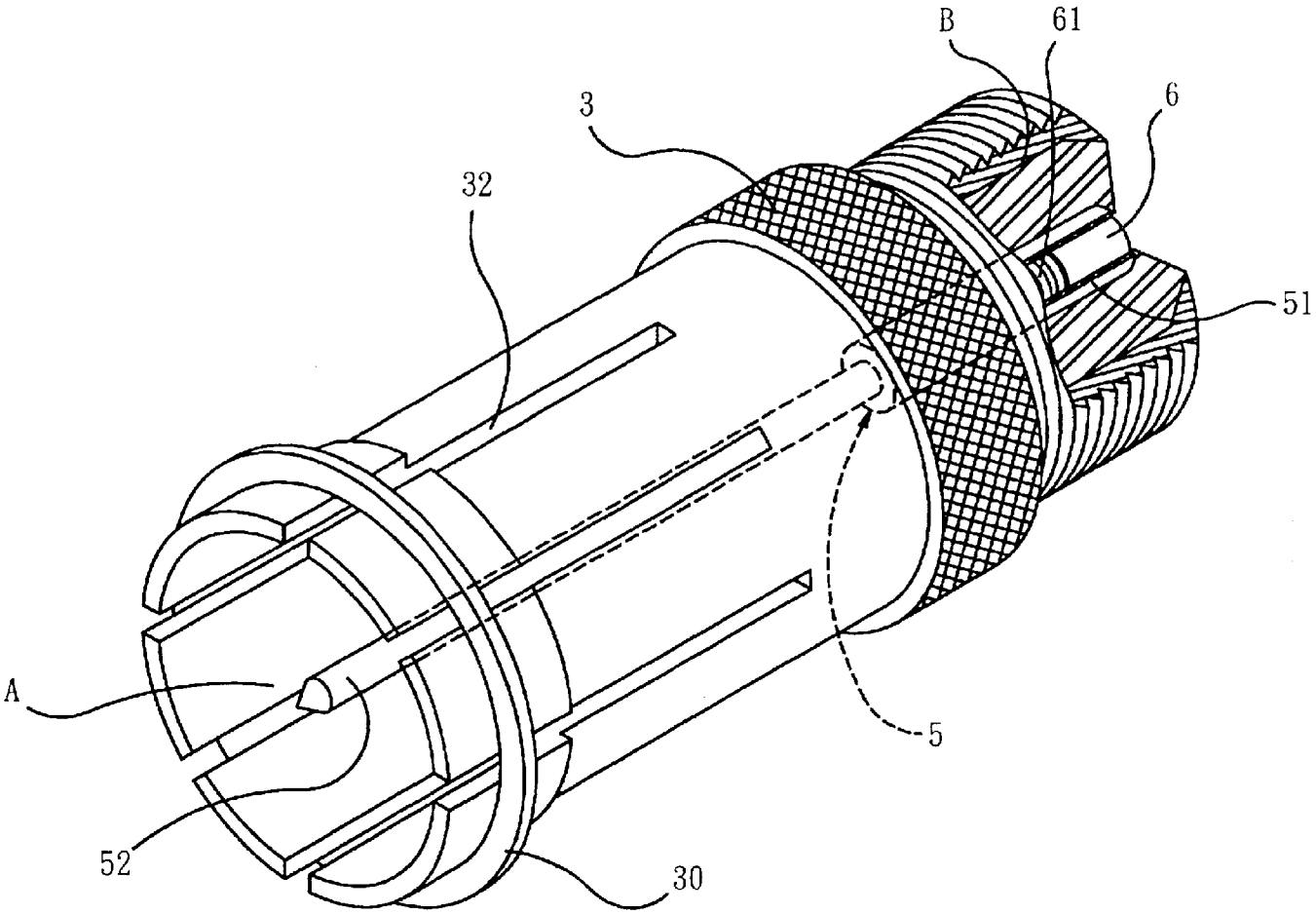
Figure 4:
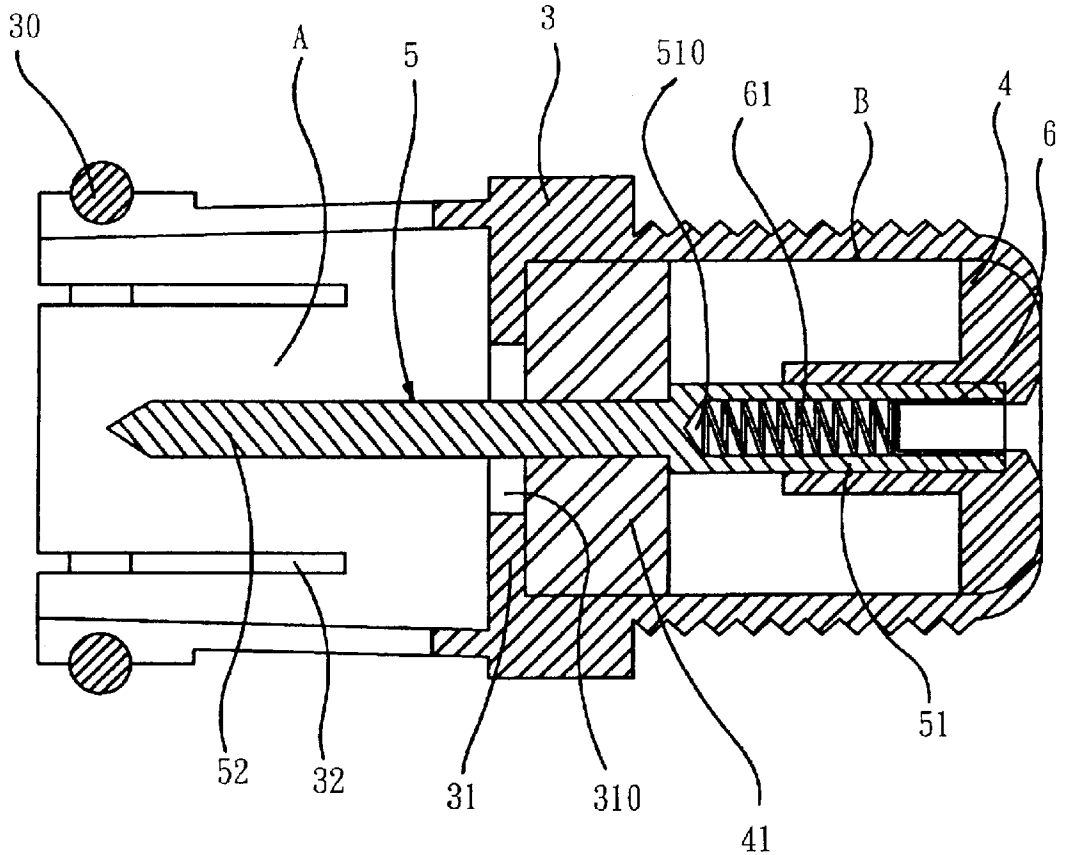
Figure 5:
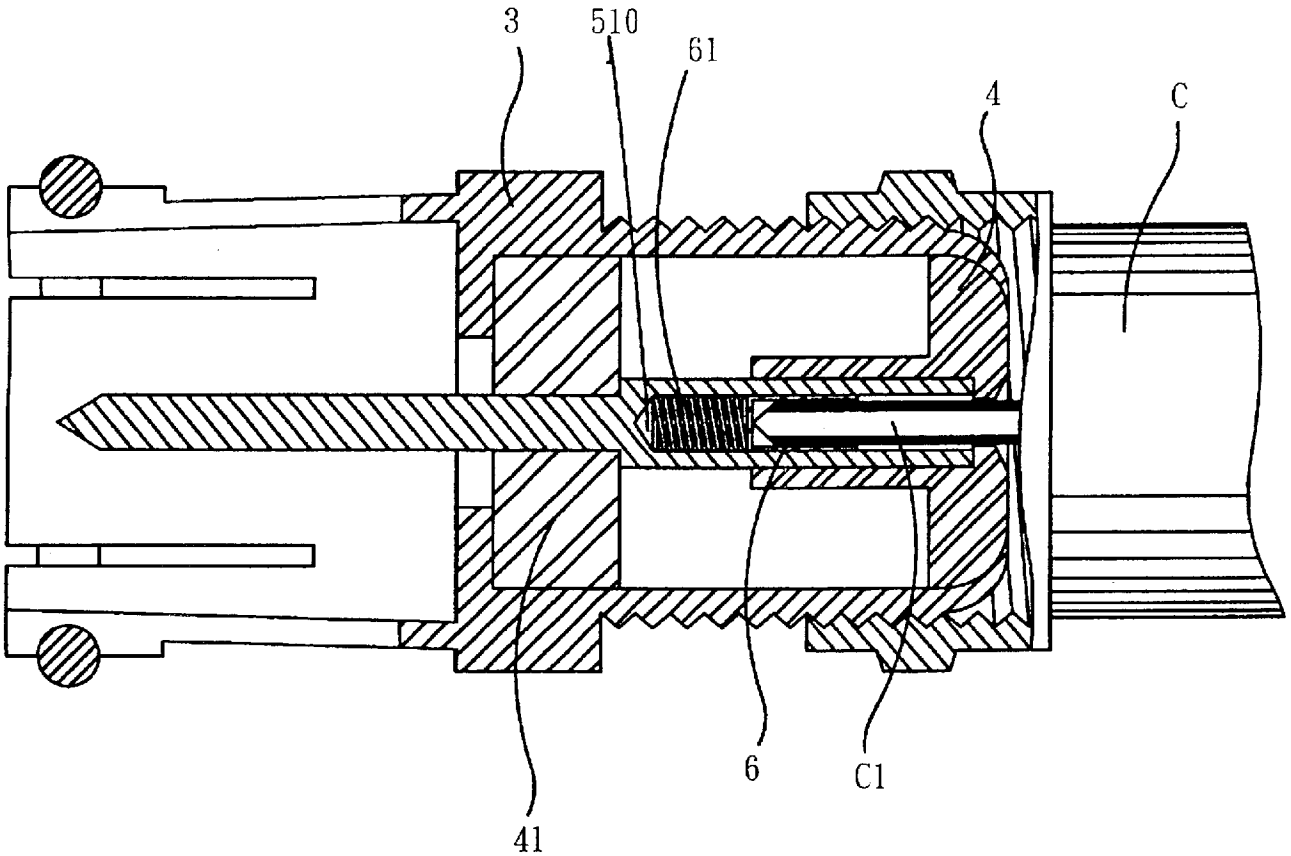
Figure 6:
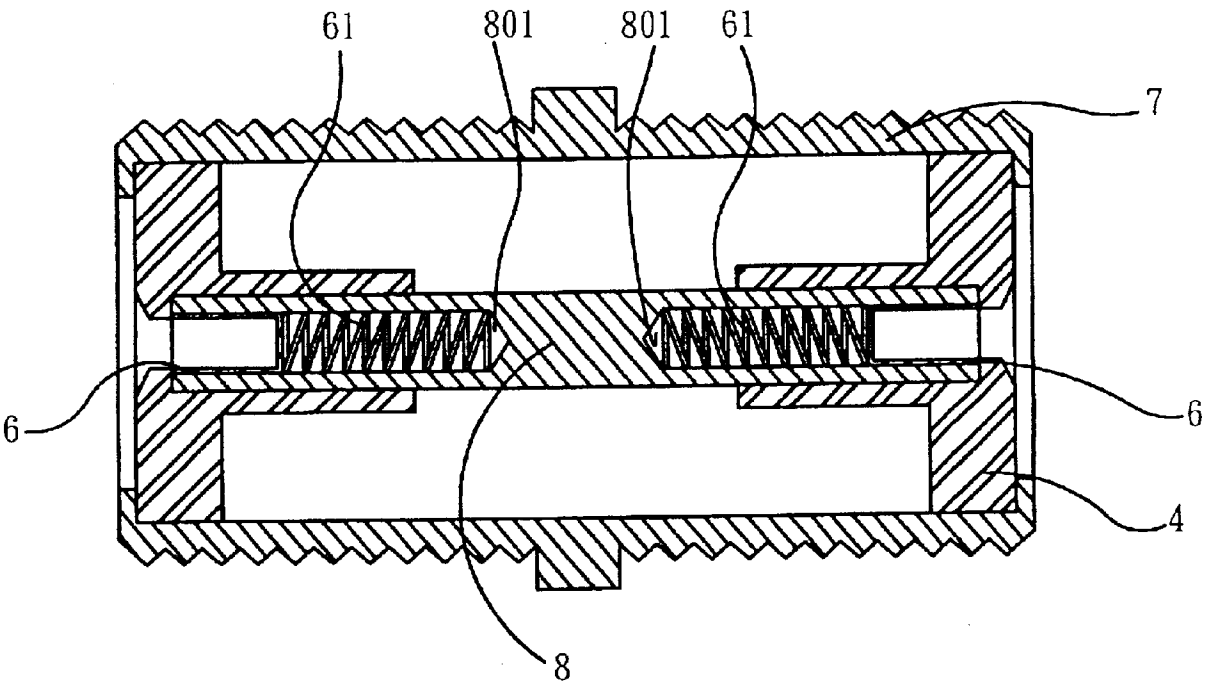

The present invention can be fully understood by referring to the following descriptions and accompanying drawings, in which:

FIG. 1 is a planar cross-sectional view, showing a known conventional RF coaxial connector;

FIG. 2 is a schematic view, showing a known conventional RF coaxial connector in use, FIG. 3 is a partly cross-sectional perspective view, showing a RF coaxial connector according to a preferred embodiment of the present invention, FIG. 4 is a planar cross-sectional view, showing a RF coaxial connector according to a preferred embodiment of the present invention as shown in FIG. 3, FIG. 5 is a cross-sectional view, showing a RF coaxial connector in use according to a preferred embodiment of the present invention as shown in FIG. 3; and FIG. 6 is a schematic view, showing a Re coaxial connector according to another preferred embodiment of the present invention.

DETAILED DESCRIPTIONS OF THE PREFERRED EMBODIMENTS

First, please refer to FIGS. 3 and 4 which show a RF coaxial connector implementing a preferred embodiment of the present invention. The RF coaxial connector comprises an outer conductor (3), a dielectric insulator (4), an inner conductor (5), an U-type cylinder (6), and an elastic element (61). The outer conductor (3) is a hollow conductor made of conductive material. A blocker part (31) is disposed in the outer conductor (3) to separate it into two sections: front section (A) and rear section (B). A through hole (310) is disposed at the center of the blocker part (31) providing a passage for the inner conductor (5) to extend from Section A to Section B of the outer conductor (3) with the front portion (52) of the inner conductor (5) in the front section (A). Here, a non-conductive supporter element (41), which is disposed against the blocker part (31), is used to hold the inner conductor (5) and keep it concentric with the outer conductor (3). The outer wall of Section A of the outer conductor (3) has several slits (32) and a clamping ring (30) is used to constrain the front end of Section A. The outer wall of Section B of the outer conductor (3) is threaded for another RF coaxial connector to screw and fix thereon. A dielectric insulator (4) is installed between the outer conductor (3) and inner conductor (5) in Section B of the outer conductor (3) to support the inner conductor (5) and insulate it from the outer conductor (3). An insertion hole (510) is disposed axially at the interface end (51) of the inner conductor (5). An elastic element (61) and an U-type cylinder (6) made of conductive material area installed in the insertion hole (510). One end of the elastic element (61) presses against the bottom of the insertion hole (510) and the other end thereof resists against the bottom of the U-type cylinder (6). The outer diameter of the U-type cylinder (6) is almost equal to the inner diameter of the insertion hole (510) so that the outer wall of the U-type cylinder can physically contact the inner wall of the insertion hole thus forming an electric continuity.

Next, please refer to FIG. 5. The center conductor (C1) projecting from the center of a coaxial cable (C) can 7>insert correspondingly into the U-type cylinder and presses against the bottom thereof when the RF coaxial connector made according to the present invention is engaged with the end of the coaxial cable (C). Meanwhile, a rebounding force is yielded in the elastic element (61) disposed between the U-type cylinder (6) and the bottom of the insertion hole (510) as the center conductor presses down the U-type cylinder (6) and consequently presses down the elastic element (61). The elastic element (61) resists against the U-type cylinder (6) owing to the yielded rebounding force so as to ensure a good electric continuity between the center conductor (C1) and the U-type cylinder (6). As a result, a good signal transmission is yielded through the good electric continuity between the U-type cylinder and the inner wall of the insertion hole (510). The elastic element (61) pushes the U-type cylinder (6) back to its original position for next engagement when the coaxial cable (C) is separated from the RF coaxial connector.

The RF coaxial connector made according to the present invention achieves electric continuity by means of having the center conductor (C1) press against the bottom of the U-type cylinder (6) and then the outer wall of the U-type cylinder (6) physically contact the inner wall of the insertion hole (510); therefore, the inner diameter of the U-type cylinder (6) is not limited to a specific dimension and can be used on a variety of coaxial cables with different specifications. Besides, the U-type cylinder (6) of the present invention does not require undergoing the aforementioned slit-and-crimp process to engage with and hold the cable center conductor (C1), bad contact or contact failure resulting from elastic fatigue, as most of the conventional coaxial connectors have experienced never happens.

The material used for the elastic element (61) in the RF coaxial connector according to the present invention is not limited to any particular material. It can be either conductive or non-conductive, as long as it is an elastic material. For example, it can be a metallic spring or a conductive or non-conductive tubular silicon rubber that can provide the RF coaxial connector made according to the present invention with needed elasticity.

Next, please refer to FIG. 6 that shows a RF coaxial connector implementing another preferred embodiment of the present invention. The RF coaxial connector comprises a hollow outer conductor (7), an inner conductor (8), and a dielectric insulator (4). An insertion hole (801) is disposed axially at each of the two interface ends of the inner conductor (8). An elastic element (61) and U-type cylinder (6) are installed in each insertion hole (801). One end of the elastic element presses against the bottom of the insertion hole (801) and the other end thereof resists against the bottom of the U-type cylinder. The outer diameter of the U-type cylinder is almost equal to the inner diameter of the insertion hole (801) so that the outer wall of the U-type cylinder (6) can physically contact the inner wall of the insertion hole thus forming an electric continuity. The outer wall of the outer conductor (7) is threaded for another RF coaxial connector to screw thereon to form an electric continuity.

Each end of the RF coaxial connector made according to the present invention shown in FIG. 6 can be connected to the coaxial cable (C) as illustrated in FIG. 5. The center conductor (C1) is inserted into the U-type cylinder (6) of the RF coaxial connector made according to the present invention, and is pressed against the bottom of the U-type cylinder (6) so as to allow the elastic element (61) to rebound to resist against the bottom of the U-type cylinder (6) to ensure that a solid electric continuity is formed between the center conductor (C1) and the U-type cylinder. The elastic element (61) pushes the U-type cylinder back to its original position by the rebounding force thereof for next engagement when the coaxial cable (C) is separated from the RF coaxial connector. The RF coaxial connector made according to the present invention shown in FIG. 6 can be used as a splice adapter to connect two coaxial cables to form an extended coaxial cable for a particular application.

What is claimed is:

1. A radio frequency coaxial connector, mainly comprising, a hollow outer conductor and an inner conductor, the said inner conductor being installed concentrically in the outer conductor and dielectric insulated from the outer conductor;

an insertion hole is disposed axially in an interface end of the inner conductor, an elastic element and an U-type cylinder are installed in the insertion hole, and the outer diameter of the U-type cylinder is almost equal to the inner diameter of the insertion hole so that the outer wall of the U-type cylinder physically contacts the inner wall of the insertion hole of the said inner conductor to form an electric continuity with the inner conductor; and one end of the said elastic element presses against the bottom of the said insertion hole, the other another end thereof resists against the bottom of the U-type cylinder, of the elastic element provides rebounding pressure on the U-type cylinder to ensure that an electric continuity is formed between a center conductor of a coaxial cable and the inner conductor when the center conductor of the id coaxial cable is inserted into the U-type cylinder.

2. A radio frequency coaxial connector, comprising:

hollow outer conductor and an inner conductor, the inner conductor being installed concentrically in the outer conductor and dielectric insulated from the outer conductor;

an insertion hole is disposed axially at each of the two interface ends of the said inner conductor; an elastic element and an U-type cylinder are installed in each of the insertion holes, and the outer diameter of the U-type cylinders is almost equal to the inner diameter of the sa insertion holes so that the outer wall of the U-type cylinders physically contact the inner wall of the insertion holes of the said inner conductor to form an electric continuity with the inner conductor; and one end of each of the elastic elements presses against the bottom of each seed a respective one of the insertion hole, the other holes, another end of each of the elastic elements resists against the bottom of the said a respective one of the U-type cylinders, the elastic elements provide rebounding pressure on the respective ones of U-type cylinders to ensure that an electric continuity is formed between the center conductor of a coaxial cable and the inner conductor when the center conductor of the coaxial cable is inserted into the U-type cylinder.

3. The frequency coaxial connector according to claim 1, wherein a dielectric insulator is installed between the hollow outer conductor and the inner conductor.

4. The radio frequency coaxial connector according to claim 3, wherein the dielectric insulator is configured to fix the U-type cylinder in the insertion hole.

5. The radio frequency coaxial connector according to claim 2, wherein a pair of dielectric insulators are installed between the hollow outer conductor and respective ones of the inner conductors.

6. The radio frequency coaxial connector according to claim 5, wherein the dielectric insulators are configured to fix the U-type cylinders in the insertion holes.

* * * * *